United States Patent [19]

Iwasaki et al.

[11] Patent Number: 4,534,721

[45] **Date of Patent: * Aug. 13, 1985**

[54] BRICK-FORMING VACUUM PRESS

[75] Inventors: Shigeo Iwasaki, Okayama; Hiroshi Haguchi, Saidaiji, both of Japan

[73] Assignee: Mitsuishi Fukai Tekkosho Ltd., Okayama, Japan

[ * ] Notice: The portion of the term of this patent subsequent to Nov. 29, 2000 has been disclaimed.

[21] Appl. No.: 541,172

[22] Filed: Oct. 12, 1983

Related U.S. Application Data

[63] Continuation-in-part of Ser. No. 333,821, Dec. 16, 1981, Pat. No. 4,417,864.

[30] Foreign Application Priority Data

Oct. 14, 1982 [JP] Japan ..... 57-180197

[51] Int. Cl.[3] ..... B30B 11/02

[52] U.S. Cl. ..... 425/73; 425/352; 425/405 R; 425/406

[58] Field of Search ..... 425/73, 352, 405 R, 425/406; 264/701, 102

[56] References Cited

U.S. PATENT DOCUMENTS

| | | | |
|---|---|---|---|
| 2,513,785 | 7/1950 | Browne | 264/102 |
| 3,712,785 | 1/1973 | Hirt | 264/102 |
| 3,784,343 | 1/1974 | Iwasaki | 425/352 |
| 3,832,107 | 8/1974 | Cox | 425/73 |

FOREIGN PATENT DOCUMENTS

| | | |
|---|---|---|
| 48-44307 | 6/1973 | Japan . |
| 48-67306 | 9/1973 | Japan . |
| 52-150409 | 12/1977 | Japan . |
| 1160137 | 7/1949 | United Kingdom . |

*Primary Examiner*—John A. Parrish

*Attorney, Agent, or Firm*—Beveridge, DeGrandi and Weilacher

[57] ABSTRACT

A brick-forming vacuum press is provided with a die and top and bottom plungers which are disposed along the same vertical central axis as the die. Spaces which extend from the die and surround the top and bottom plungers are enclosed by chambers formed of sealing cylinders, flexible bowl-like skirts and sealing flanges. A horizontal table is provdided on the die to support a mix-filling charger and a compact-discharging pickup device. A wiper is carried by the pickup device to clean the table when the pickup device is shifted away from the vertical central axis of the press. Controls are provided to automate the filling of the die, press-forming and discharging of the resultant compact.

12 Claims, 4 Drawing Figures

BRICK-FORMING VACUUM PRESS

REFERENCE TO RELATED APPLICATION

This is a continuation-in-part of copending U.S. patent application Ser. No. 333,821 filed Dec. 16, 1981, entitled Vacuum Type Brick Forming Machine and now U.S. Pat. No. 4,417,864. The content of this earlier application is incorporated herein by reference.

BACKGROUND OF THE INVENTION

This invention relates to a brick-forming vacuum press, and more particularly to such a press which is equipped with flexible sealing means.

An earlier brick-forming vacuum press was disclosed by the present assignee in Japanese patent application No. 58161/1971, filed Aug. 2, 1971. In the ensuing years, further developments and improvements have been made, and presses of this nature have found wider commercial utility year after year.

A brick-forming vacuum press is generally constructed of a die and top and bottom plungers disposed along the same vertical central axis. The die is located between the plungers so that a mix placed in the die will be compressed by means of the top and bottom plungers. To facilitate charging of the mix into the die and discharging of a resulting product from the die, the die and the plungers are vertically movable relative to each other.

In apparatus of this nature, it is extremely important to maintain a vacuum in the space defined by the die and plungers. On this subject, the present assignee filed Japanese Utility Model Application No. 185870/1981 on Dec. 14, 1981, disclosing a vacuum chamber which utilizes a flexible skirt element. An attribute of such a skirt is that it permits a greater expansion/contraction stroke along the central vertical axis of the press.

The apparatus disclosed in this specification is particularly advantageous because, in addition to providing effective sealing and permitting greater strokes of the press elements, it provides a superior production efficiency.

According to this invention, it is possible to maintain a degree of vacuum which has been difficult to achieve in prior art presses. The invention permits full automization of a high performance brick forming vacuum press which successively performs the functions of charging a mix into the die, pressing the mix between the top and bottom plungers in a vacuum, and removing the resulting compact. This is done without substantial interruption and without the attendance of any operators or workers. The operational reliability is extremely high, and there are significant improvement in production efficiency.

SUMMARY OF THE INVENTION

According to this invention, a vacuum press for forming brick compacts has a die and top and bottom plungers disposed on a common vertical axis. Upper and lower vacuum chambers enclose the upper and lower spaces which surround the top and bottom plungers and extend to the die. One characterizing feature of the invention is that at least one of the vacuum chambers includes a flexible bowl-like skirt and a sealing flange connected thereto.

In another respect, the invention involves a vacuum press with top and bottom plungers, a die, and a vacuum chamber for enclosing a space which surrounds the plunger and extends to the die. The vacuum chamber includes a sealing flange, a flexible skirt which has an outer circumference connected to the sealing flange and an inner circumference which is vertically fixed relative to the respective plunger and vertically movable relative to said outer circumference. The flexible skirt is deformable so that a surface thereof deforms from a concave configuration to a convex configuration in response to vertical relative movement between its inner circumference and its outer circumference.

There are a number of additional desirable and preferable features of the invention. For example, the sealing flange may be bowl-shaped and complementary to the flexible skirt. The flexible skirt has a height which is at least about one-half the difference between its outside radius and its inside radius. The skirt is constructed and used so that a surface thereof will deform from a concave configuration to a convex configuration in response to vertical relative movement between its inner and outer circumferences or between the sealing flange and its respective plunger.

The vacuum chamber may also include a cylindrical member which is connected to the inner edge of the flexible skirt. In this instance, the outer edge of the flexible skirt is connected to the sealing flange.

The upper vacuum chamber preferably has a sealing flange provided with a sealing edge which is movable into sealing contact with the die. In this regard, the term "die" includes the die and its associated components such as the die holder and a table mounted on the die. The sealing flange has a convex surface which faces the die, and the flexible skirt has a lower surface which deforms from a convex configuration to a concave configuration in response to downward movement of the sealing flange relative to the top plunger.

The disclosed apparatus is provided with a pickup means which is movable in a horizontal path and is operable to engage a brick compact and remove it from the press when the top plunger is in a raised position and the die is in a lower position. The top plunger, sealing flange and flexible skirt are located above the path of the pickup device when the top plunger is in its raised position.

The apparatus also preferably is provided with a horizontal table which is mounted on the die. This table supports a horizontally reciprocating charger means for charging the die with the material which is to be compressed. A horizontally reciprocating pickup means mounted on the table is used to remove a compressed product. The charger means and the pickup means are located on opposite sides of the vertical central axis and they are operable independently of each other. It is particularly desirable to provide a wiper means which moves horizontally with the pickup means to wipe off the table during movement of the pickup means.

DETAILED DESCRIPTION

Figure 1:
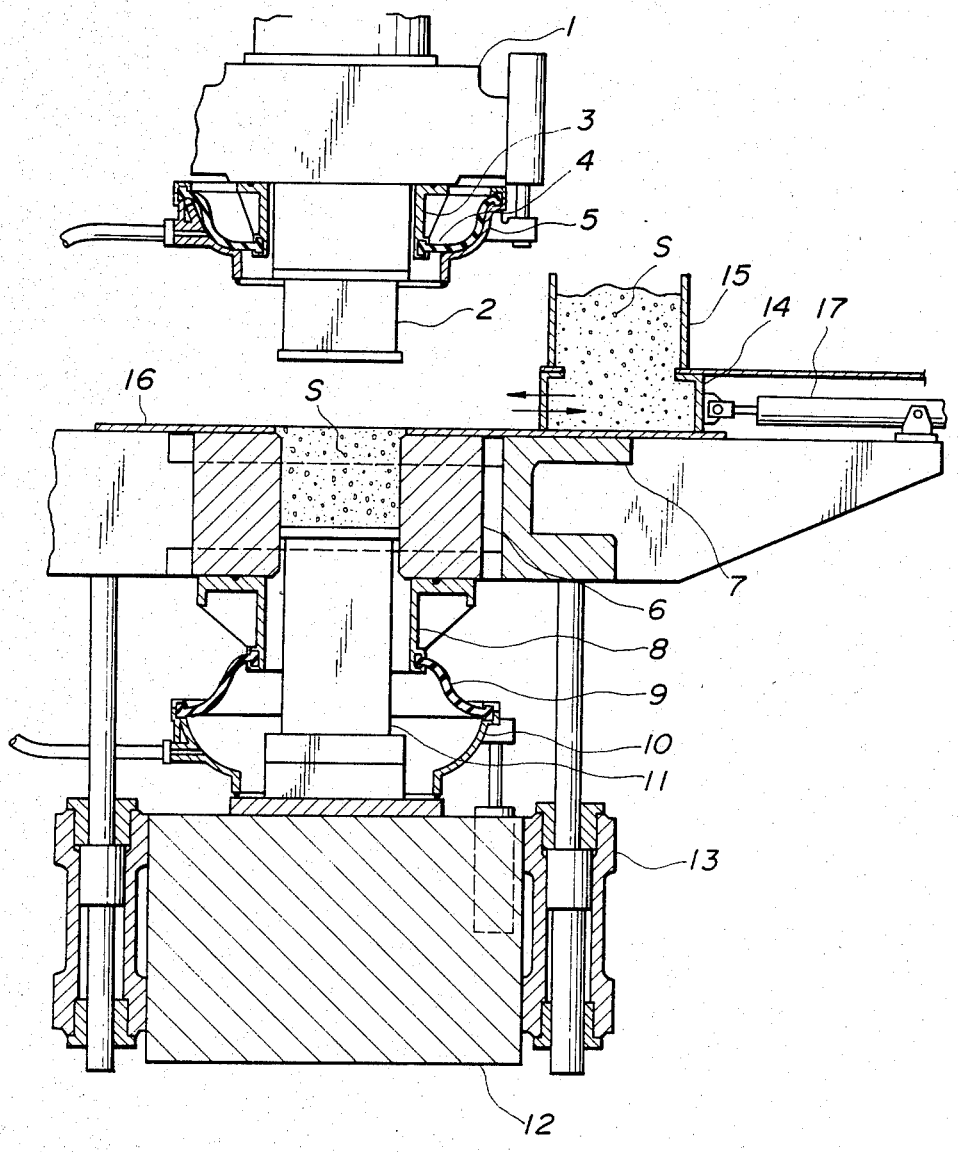
FIG. 1 is a vertical cross sectional view of a preferred embodiment of a brick-forming vacuum press constructed according to the invention, as seen after the charger has deposited a mix in the die.
Figure 2:
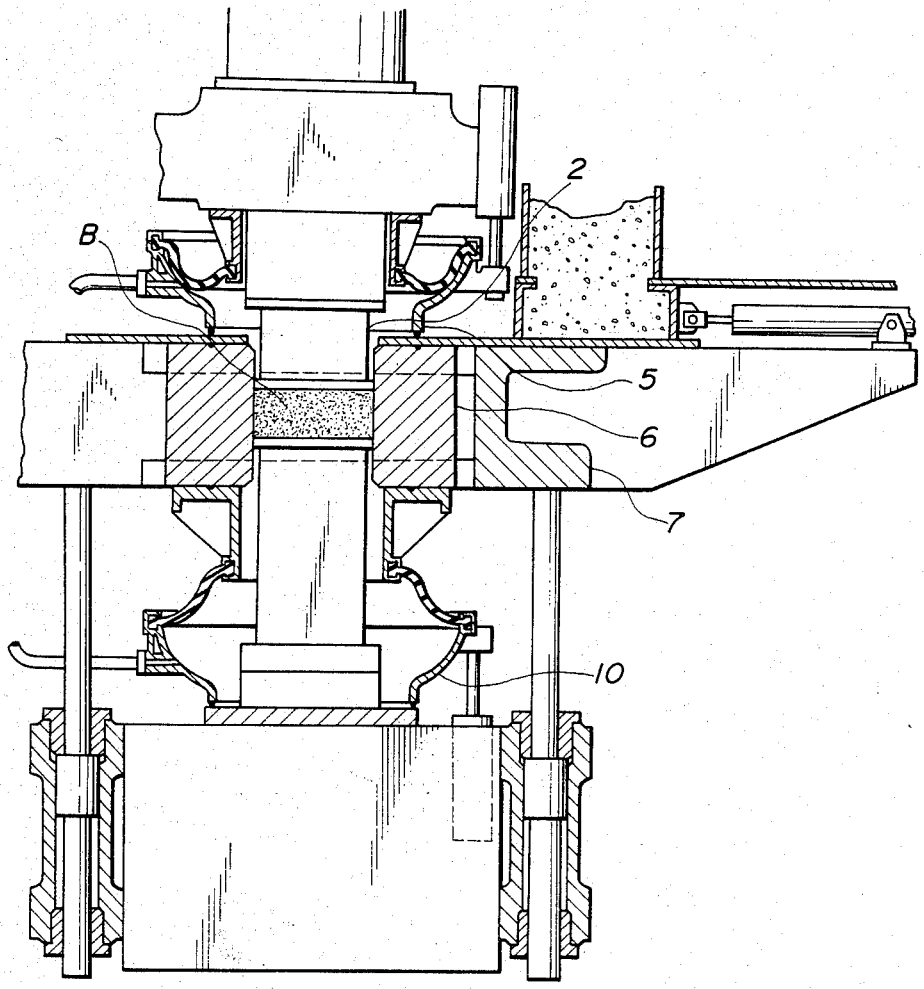
FIG. 2 is a view similar to FIG. 1 but showing the apparatus at the conclusion of the compression stroke of the top plunger.
Figure 3:
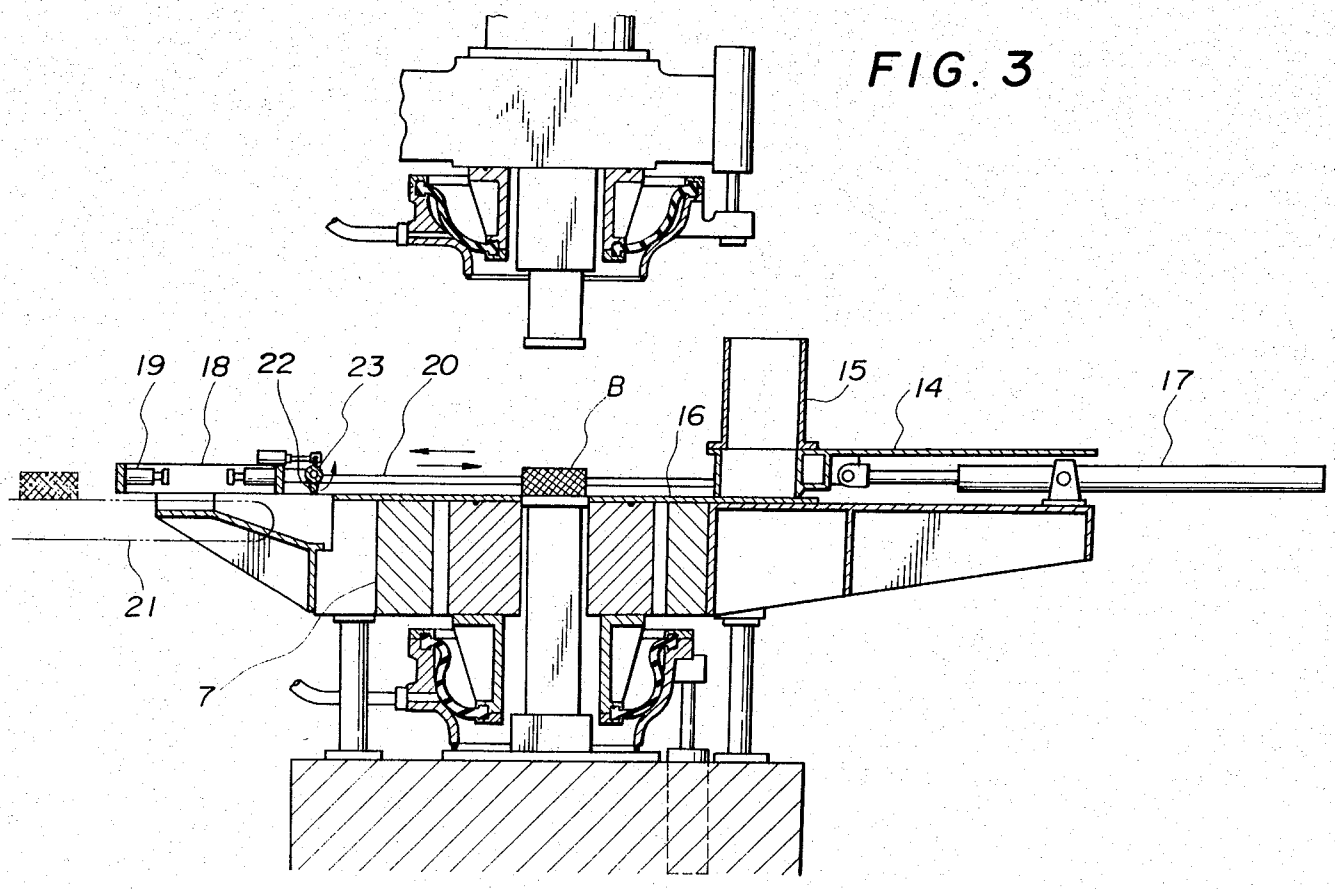
FIG. 3 is a front elevation, partially in section, showing the pickup device, table wiper and other components at a time immediately after a compact has been removed by the pickup device; and, FIG. 4 is a plan view of the apparatus of FIG. 3.

As shown in FIGS. 1-3, the apparatus has a top plunger 2, a die 6 and a bottom plunger 11 which are disposed on a common vertical axis. These members are vertically movable relative to each other to compress the mix in the die and to eject from the die the compressed product which is known as a "compact." The vertical movement which occurs between the top plunger 2 and the die 6 also provides a space which permits charging of the die with the mix, and pickup and removal of the compact from the die.

In the preferred embodiment, the bottom plunger 11 is stationary. The die holder 7 and die 6 are vertically moved by cylinders 13 between a raised die-charging position shown in FIG. 1 and a lower compact-ejecting position shown in FIG. 3. A ram 1 moves the top plunger 2 from the raised position of FIG. 1 to the lower position of FIG. 2 where it enters and the die and compresses the material therein.

To provide a vacuum during compression of the mix, vacuum chamber means are provided around the top and bottom plungers 2 and 11. When the material is being compressed, these vacuum chambers extend to the die 6 and they are connected to a vacuum source by vacuum hoses 5' and 10'.

The upper vacuum chamber is formed of a rigid sealing cylinder 3, a flexible skirt 4 and a rigid sealing flange 5. The skirt 4 has a bowl-like configuration. Its height is at least about one-half the difference between its outside radius and its inside radius. Its inner circumference is sealingly connected to the cylinder 3, and its outer circumference is sealingly connected to the flange 5. The flange 5 is bowl-shaped and complementary to the skirt 4; and, it has a convex lower surface which faces the die 6. A packing ring is provided on the bottom of the flange 5 in order to achieve an almost complete hermetic seal against the die assembly. A hydraulic actuator 5" moves the flange 5 vertically relative to the plunger 2 from the retracted position shown in solid lines in FIG. 1 to an extended position shown in broken lines in FIG. 1. During downward movement of the flange 5 to its extended position, the outer circumference of the flexible skirt 4 moves downwardly relative to its inner circumference so that, as shown in FIG. 1, the lower surface of the flexible skirt deforms from a convex configuration to a concave configuration. When the flange 5 is extended, its lower surface is in sealing engagement with the upper surface of the die assembly. The vacuum chamber may then be evacuated through hose 5' so that, during the subsequent compression movement of the plunger 2 into the die cavity, the mix will be in a vacuum.

The vacuum chamber around the lower plunger is formed of a rigid sealing cylinder 8 which is connected to the lower surface of the die 6, a bowl-like flexible skirt 9 which has its inner circumference connected to the cylinder 8, and a rigid sealing flange 10 which is connected to the outer circumference of the flexible skirt 9. The upper surface of the sealing flange 10 is concave. The height of skirt 9 is at least about one-half the difference between its outside diameter and its inside diameter. When the die 6 is moved downwardly relative to the bottom plunger 11, the skirt 9 is deformed as its inner circumference moves downwardly relative to its outer circumference. During this deformation, the upper surface of skirt 9 goes from the convex form shown in FIGS. 1 and 2 to the concave form shown in FIG. 3. A hydraulic actuator 10" is operable to move the flange 10 a small distance from an upper venting position to a lower sealing position where its lower surface sealingly engages the upper surface of a plate 12' on the base 12. The efficacy of this seal is enhanced by providing the bottom of flange 10 with a packing ring as shown.

The die is filled by a charger 14 and the compacts are removed by a pickup device 18, both of which are described in Japanese patent application No. 75244/1973 and Japanese Pat. No. 78840 of the present assignee. Referring to FIG. 1, it will be seen that the charger 14 reciprocates rightward and leftward on a table 16 which is affixed to the die holder 7. In this specification, the die 6, die holder 7 and table 16 are referred to collectively as the die assembly. Number 17 designates a hydraulic cylinder for moving the mix-filling charger 14. The charger 14, after receiving the mix from a horizontally immovable hopper 15, is initially shifted by cylinder 17 in a leftward direction to fill the central cavity of the die 6 with the mix S. During this cavity filling step, the top plunger 2 and the die holder 7 are in their uppermost positions. The mix filling charger 14 then returns to its rightmost position beneath the hopper 15.

Upon completion of the die-filling step, the top and bottom flanges 5 and 10 of the vacuum chambers are lowered to the positions illustrated in FIG. 2, to seal the upper and lower chambers around the plungers and the die cavity. After evacuating the air from the upper and lower chambers to provide a vacuum therein, the ram 1 descends with the top plunger 2 to compress the mix S in the die 6 as shown in FIG. 2.

Figure 4:
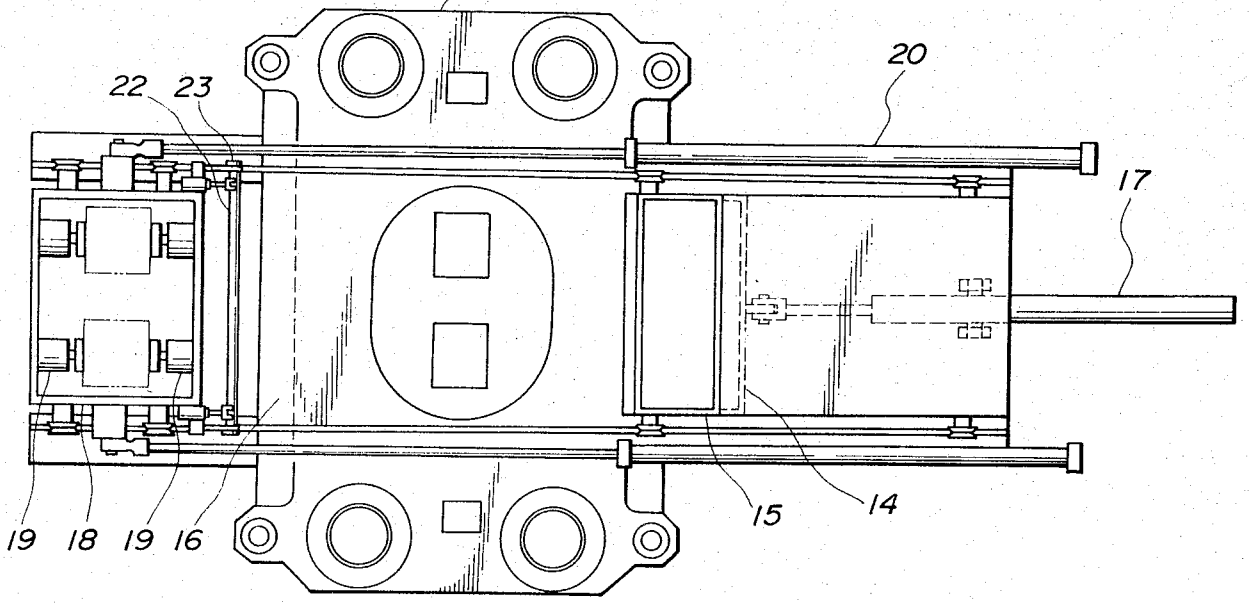

After forming the mix S into a compact, the top plunger 2 and top sealing flange 5 are raised to their initial positions which are above the horizontal path of the pickup device described below. As shown in FIG. 1, this provides a wide space over the die holder 7. While the top plunger 2 and top sealing flange 5 are held in these positions, the pickup device 18 shown in FIGS. 3 and 4 is shifted rightward by a pair of hydraulic cylinders 20 which are located on opposite sides of the table. The pickup device is positioned directly above the die 6, and the hydraulic cylinder 13 is contracted to lower the die holder 7 to the position shown in FIG. 3. This ejects the compact B from the die and holds it above the table 16 where it enters the pickup device. The compact B is then grasped between grips 19 and the pickup device 18 is shifted leftward to transfer the compact B onto a takeoff conveyor 21. The charger 14 and pickup device 18 are operated without any interference.

A feature of this invention resides in the provision of a pivoted elastic rubber wiper 22 which is mounted on and movable with the pickup device 18. As seen in FIG. 3, the wiper 22 is pivotally moved about a transverse horizontal pin 23 by an actuator 22'. When the pickup device 18 moves rightward, the actuator 22' holds the wiper at a position where its lower wiping edge is spaced above the table 16. When the pickup device 18 comes close to the charger 14 and its direction of movement is reversed, actuator 22' turns the wiper 22 in the opposite direction so that its rubber blade is pressed against the upper surface of the table 16. As the pickup device moves leftward, the wiper 22 completely cleans the upper surface of the table 16. This cleaning operation is carried out repeatedly, thereby providing a clean surface which is sealingly engaged by the flange 5 to play an important role in the maintenance of a high degree of vacuum.

The operation of the brick-forming vacuum press according to this invention may be summarized as follows:

(a) The sealing flange 5 of the top plunger 2 is raised by actuator 5'' to form a relatively high space beneath the top plunger 2. The die holder 7 is held at its uppermost position;

(b) The charger 14 is shifted leftward to the vertical central axis of the press and, after filling the cavity of the die 6 with the mix S, is shifted back to the right;

(c) The top and bottom sealing flanges 5 and 10 are moved by actuators 5'' and 10'' into sealing engagement with the die assembly and the bottom plate 12';

(d) Air is evacuated from the spaces defined by the die assembly, sealing flanges, and skirts; and the top plunger 2 is driven downwardly to compress the mix S in the die;

(e) As soon as the forming has finished, the plunger 2 and upper flange 5 are raised, and pickup device 18 is shifted rightward to assume a position on the vertical central axis of the press. Then, the die holder 7 is lowered so the bottom plunger 11 will eject the compact B upwardly into the pickup device 18;

(f) The compact B is engaged by the grips 19 of the pickup device 18. The pickup device 18 is then moved leftward by cylinders 20 to transfer the compact B to the conveyor 21; and (g) The pickup device 18 is again moved to the right, the rubber blade of the wiper 22 is lowered, and the pickup device 18 moves leftward so that blade 22 wipes off the upper surface of the table 16 completely.

In the course of machine operation, there is no interference between any of the steps (a) to (g). Since the up and down stroke of each of the flexible bowl-shaped skirts 4 and 9 may be large, the horizontal displacement of the pickup device 18 is not hampered at all. In the present age of automation, it is extremely easy to carry out the above steps successively without the attendance of operators or workers. For example, (b) is started automatically after completion of the step (a), and then step (c) is started automatically after completion of step (b).

It will be evident that the invention may be modified in many ways. For example, the apparatus may have a vertically immovable die which is positioned between vertically movable top and bottom plungers without altering the advantages and effects of this invention. The lower sealing edge of the flange 10 may be affixed and permanently sealed to the plate 12' of the base. Step (f) may be performed between steps (a) and (b) to remove any mix left on the table 16 by the charger 4; or, the wiper 22 may be lowered during the leftward movement of the pickup device in step (f) in order to avoid step (g) which involves an additional stroke of the pickup device. Further, the ram which drives the top plunger may be actuated by a hydraulic cylinder, a toggle mechanism or a screw with a frictional flywheel.

Having now fully described the invention, it will be apparent to persons of ordinary skill in the art that many changes and modifications can be made thereto without departing from the spirit or scope of the invention as set forth herein.

We claim:

1. A vacuum press for forming brick compacts, comprising, a die, a top plunger and a bottom plunger all disposed on a common vertical central axis, upper and lower vacuum chamber means for enclosing upper and lower spaces which surround the top and bottom plungers and extend to the die, at least one of said vacuum chamber means including a sealing flange and a flexible bowl-like skirt, said sealing flange being connected to said flexible skirt.

2. A vacuum press according to claim 1 wherein said at least one vacuum chamber means includes a cylindrical member, said flexible bowl-like skirt having an inner edge connected to the cylindrical member and an outer edge connected to the sealing flange.

3. A vacuum press according to claim 1 wherein the upper vacuum chamber means includes said sealing flange and said flexible skirt, said sealing flange having a sealing edge which is movable into sealing contact with the die, said sealing flange having a convex surface which faces said die, said flexible skirt having a lower surface which is deformable from a convex configuration to a concave configuration in response to downward movement of the sealing flange relative to the top plunger.

4. A vacuum press according to claim 1 wherein the flexible skirt is deformable so that a surface thereof deforms from a concave configuration to a convex configuration in response to vertical relative movement between said sealing flange and its respective plunger.

5. A vacuum press according to claim 1 wherein both of said vacuum chamber means include a said sealing flange and a said flexible skirt.

6. A vacuum press according to claim 1 wherein the bottom plunger is stationary, said die being vertically movable between a raised die-charging position for filling the die and a lower compact-ejecting position for ejecting a brick compact from the die, said top plunger being vertically movable from a raised position to a lower position where it enters the die to compress material therein, and pickup means which is movable in a horizontal path and is operable to engage a brick compact and remove it from the press when the top plunger is in its raised position and the die is in its lower position, said upper vacuum chamber means including said sealing flange and said flexible skirt; said top plunger, said sealing flange and said flexible skirt being located above the path of said pickup device when the top plunger is in its raised position.

7. A vacuum press according to claim 1 wherein said sealing flange is bowl-shaped and is complementary to said flexible skirt.

8. A vacuum press according to claim 1 wherein said flexible skirt has a height, an outside radius and an inside radius; said height being at least about one-half the difference between said outside radius and said inside radius.

9. A vacuum press according to claim 1 wherein the flexible bowl-like skirt has an inner circumference and an outer circumference, said inner and outer circumferences being vertically movable relative to each other during operation of the vacuum press, said flexible skirt having a surface which deforms from a concave to a convex configuration in response to said relative vertical movement.

10. A vacuum press according to claim 1 wherein said die is provided with a horizontal table, horizontally reciprocating charger means mounted on the table for charging the die with a material which is to be compressed, horizontally reciprocating pickup means mounted on the table for removing a compressed product, said charger means and said pickup means being located on opposite sides of the vertical central axis and being operable independently of each other.

11. A vacuum press according to claim 10 wherein said table is sealingly engaged by said sealing flange to provide sealing contact between said sealing flange and said die, said press having a wiper means for wiping off said table, said wiper means being horizontally movable with the pickup means.

12. A vacuum press for forming brick compacts, comprising, a die and top and bottom plungers disposed on a common vertical central axis, vacuum chamber means for enclosing a space which surrounds a plunger and extends to the die, said vacuum chamber means including a sealing flange and a flexible skirt, said flexible skirt having an outer circumference which is connected to the sealing flange, said flexible skirt having an inner circumference which is vertically fixed relative to its respective plunger and vertically movable relative to said outer circumference, said flexible skirt being deformable so that a surface thereof deforms from a concave configuration to a convex configuration in response to vertical relative movement between its inner circumference and its outer circumference.

* * * * *